United States Patent [19]

Kriz

[11] 4,086,898

[45] May 2, 1978

[54] FUEL PUMPING APPARATUS

[75] Inventor: Miroslav Kriz, London, England

[73] Assignee: Lucas Industries Limited, Birmingham, England

[21] Appl. No.: 701,022

[22] Filed: Jun. 30, 1976

[30] Foreign Application Priority Data

Jul. 5, 1975 United Kingdom ..... 28434/75

[51] Int. Cl.[2] ..... F02D 1/04

[52] U.S. Cl. ..... 123/140 MP

[58] Field of Search ..... 123/140 R, 140 FG, 140 MP, 123/140 CC

[56] References Cited

U.S. PATENT DOCUMENTS

| | | | |
|---|---|---|---|
| 2,679,836 | 6/1954 | Evans | 123/140 MP |
| 3,910,245 | 10/1975 | Okura | 123/140 MP |
| 3,981,285 | 9/1976 | Schueler et al. | 123/140 MP X |

FOREIGN PATENT DOCUMENTS

| | | | |
|---|---|---|---|
| 2,605 | 7/1966 | Japan | 123/140 MP |

*Primary Examiner*—Charles J. Myhre
*Assistant Examiner*—Tony M. Argenbright

[57] ABSTRACT

A fuel pumping apparatus for supplying fuel to a supercharged compression ignition engine includes an injection pump having a control member the setting of which is determined by a governor including speed responsive means and a governor spring the force exerted by which is adjustable and opposes the action of the speed responsive means. A stop member is provided to limit the extent of movement of the control rod and the stop is engageable with a cam surface formed on a pivotal lever the setting of which is controlled by an air pressure responsive member subjected to the air pressure existing in the inlet manifold of the engine. In addition the pivot for the lever is mounted on a carrier member which is loaded by a spring. The spring can be deflected under certain operating conditions of the engine, by the force exerted by the governor spring and this provides a measure of torque control.

11 Claims, 5 Drawing Figures

FIG.1.
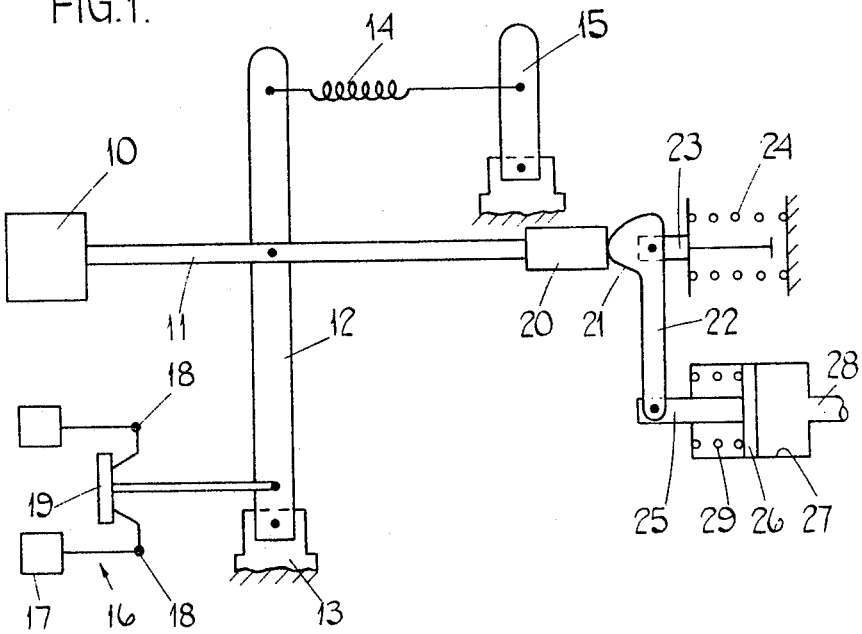
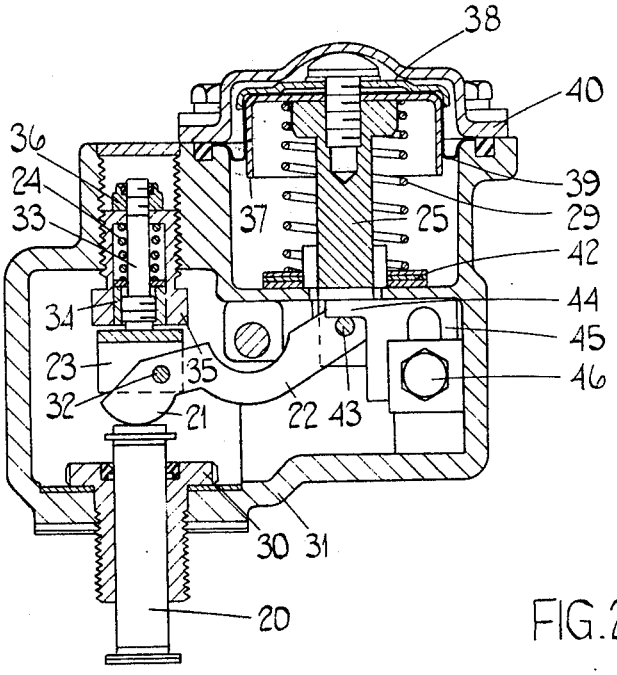
FIG.2.

FUEL PUMPING APPARATUS

This invention relates to fuel pumping apparatus for supplying fuel to a supercharged compression ignition engine, the apparatus comprising an injection pump including a control member movable axially to vary the rate of fuel supply to the engine and governor means including an operator adjustable member, speed responsive means and a governor spring, for determining the setting of the control member.

The maximum amount of fuel which can be supplied to an engine must be very carefully controlled in order that the emission of smoke from the exhaust of the engine does not exceed that permitted by the prevailing regulations. The maximum amount of fuel which can be supplied to an engine alters with the operating conditions of the engine and in the case of a supercharged engine the pressure of air in the inlet manifold of the engine is a very important factor. When the pressure is low than a reduced quantity of fuel can be supplied as compared with the situation when the pressure in the inlet manifold is high. It is also desirable to provide for torque control and the object of the invention is to provide a fuel pumping apparatus of the kind specified in a simple and convenient form.

According to the invention an apparatus of the kind specified comprises a housing, a stop member movably mounted in a wall of the housing said stop member being positioned to be engaged by said control member to determine the maximum rate of fuel supply by the apparatus, a pivot carrier mounted in the housing said pivot carrier being movable in the direction of movement of said stop member, a lever pivotally mounted on said pivot carrier, one end of said lever defining a cam surface engageable with said stop member to determine the position thereof, a fluid pressure operable member operatively connected to the other end of said lever, means whereby in use, said member can be subjected to the pressure of air in the air inlet manifold of the associated engine, first resilient means opposing movement of said fluid pressure operable member by said air pressure, and second resilient means biasing said pivot carrier, said second resilient means, being deflected by force exerted by the governor spring, to modify the maximum rate of fuel supply under certain operating conditions of the engine.

An example of an apparatus in accordance with the invention will now be described with reference to the accompanying drawings, in which:

FIG. 1 is a diagrammatic illustation of the apparatus,

FIG. 2 is a sectional side elevation of a portion of the apparatus seen in FIG. 1, FIGS. 3 and 4 are sections through the portion of the apparatus seen in FIG. 2

Figure 3:
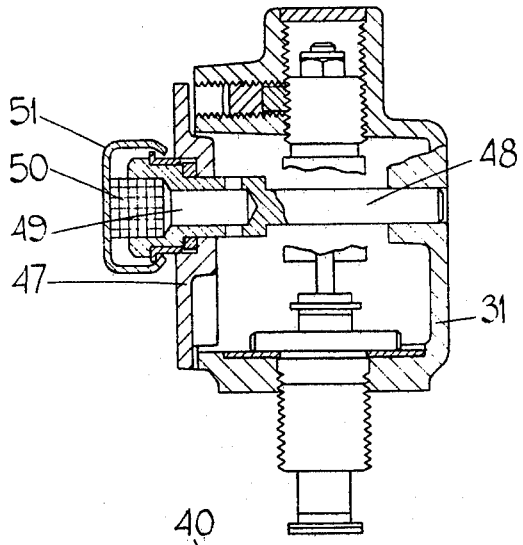

With reference to FIG. 1 of the drawings the apparatus comprises an injection pump 10 having an axially movable control member 11 the setting of which determines the amount of fuel which is supplied to the engine at each injection stroke that is to say the rate of fuel supply to the engine.

A mechanical governor is provided to determine the setting of the control member 11 and this includes a lever 12 which is pivotally connected at one end to a portion 13 of the housing of the apparatus and which intermediate its ends, is pivotally connected to the control member 11. The lever 12 at its end remote from its pivotal connection with the housing is connected to one end of a governor spring 14 the other end of which is connected to an operator adjustable lever 15. As the lever 15 is moved angularly in the clockwise direction, the governor spring 14 will exert an increased force on the lever 12 which will pivot in the clockwise direction thereby moving the control member 11 to increase the amount of fuel supply to the engine. For opposing the force exerted by the governor spring 14 a centrifugal weight mechanism generally indicated at 16 is provided. Essentially the weight mechanism includes a plurality of weights 17 which are mounted in a cage (not shown), the cage being driven at a proportion of the engine speed. Conveniently the cage is mounted on the drive shaft of the injection pump. The weights 17 are pivotally mounted at 18 and extensions of the weights bear against a flange 19 which is pivotally connected to the lever 12. As the speed of rotation of the cage increases the weights move outwardly and a force is applied to the lever 12 in opposition to the force exerted by the governor spring 14. With increasing speed the lever 12 will be moved angularly in the anticlockwise direction as seen in FIG. 1, to reduce the amount of fuel which is supplied to the engine. The engine speed is therefore controlled and an increased or decreased governed speed of the engine can be obtained by movement of the operator adjustable lever 15.

In order to control the emission of smoke from the exhaust of the engine it is necessary to provide a maximum fuel stop which limits the extent of movement of the control member 11 under the action of the governor spring 14. As shown in FIG. 1 a stop member 20 is provided but the setting of the stop member is adjustable during operation of the engine as will now be described.

The stop member engages at its end remote from the control member 11, a cam surface 21 which is defined on a pivotal lever 22. The lever is pivotally mounted in a carrier 23 and this is loaded towards the injection pump 10 by means of a coiled compression spring 24. The extent of such movement is limited by means not shown and the extent by which the spring 24 can be compressed is also limited.

The end of the lever 22 remote from its connection with the carrier 23, is connected to a rod 25 which is coupled to a fluid pressure operable member 26 and this is located within a cylinder 27 having a connection 28 to the air inlet manifold of the associated engine. Moreover, a coiled compression spring 29 is provided which biases the fluid pressure operable member 26 against the action of fluid pressure.

The associated engine is a supercharged compression ignition engine, the supercharging being effected by means of a compressor which is driven by a turbine powered by the exhaust gases of the engine. With such an arrangement it is well known that the effectiveness of the turbine depends upon the speed of and the load on the associated engine. At low speeds and low loads the turbine does not provide sufficient power to drive the compressor at a speed at which there is any substantial increase in the air pressure within the air inlet manifold, over and above atmospheric pressure. As the speed of operation of the engine increases however the energy in the exhaust gases increases and the turbine operates at a higher speed so that a substantial increase of the pressure within the air inlet manifold is obtained. The increased air pressure within the air inlet manifold results in a higher mass of air in the cylinder at the end of the compression stroke. An increased amount of fuel can therefore be supplied to the engine.

The pumping apparatus is enabled to supply an increased maximum amount of fuel by virtue of the fact that the increased pressure in the air inlet manifold effects movement of the fluid pressure operable member 26 against the action of the spring 29. Such movement results in pivotal movement of the lever 22 and by virtue of the shaping of the cam surface 21, the stop member 20 is able to move an increased amount towards the right as seen in FIG. 1. As a result of such movement, the control member 11 is moved by the governor spring to provide the increased quantity of fuel. It is emphasised that it is only when the control member 11 is in contact with the stop member 20 that an increase in the amount of fuel supplied takes place. Conveniently the coil compression spring 29 is pre-loaded so that it is only when the pressure in the air inlet manifold rises above a predetermined value is there any movement of the fluid pressure operable member 26.

The carrier 23 has a position dependent upon the spring 24 and the provision of the movable carrier provides what is known in the art as "torque control." In practice this means that as the speed of the engine increases towards the point at which the normal governor action will come into operation to reduce the amount of fuel supply to the engine, there is a slight reduction in the amount of fuel supplied to the engine as the speed increases. In other words the torque provided by the engine decreases as the engine speed increases as opposed to the situation where with a fixed maximum fuel stop the torque would remain substantially constant until the governor action explained above took place. In the position shown in FIG. 1, the spring 24 has moved the carrier 23 towards the left thereby reducing the amount of fuel supplied to the engine. If for example, the engine speed fell then the force exerted by the centrifugal governor on the lever 12 would decrease and the control member 11 would be moved towards the right, by the predominating force of the governor spring 14, thereby effecting compression of the spring 24 hence an increased quantity of fuel would be supplied to the engine.

Figure 4:
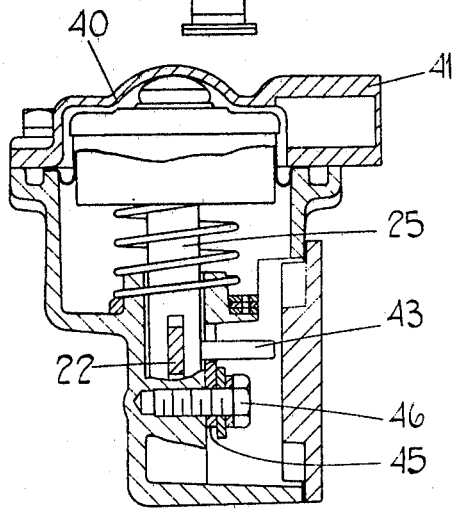

Turning now to FIGS. 2, 3 and 4 the stop member 20 is shown as slidable within a bush 30 secured in the wall of a housing 31. Moreover, the lever 22 is pivotally connected by means of a pin 32 on the carrier 23 which is of forked construction, the portion of the lever 22 defining the cam surface 21 being disposed between the forked portions of the carrier member. The main body of the carrier member 23 is integral with a rod 33 about which is located the spring 24. The rod 33 includes a screw threaded portion which is in screw thread engagement with a sleeve 34 slidably mounted within a bore defined in a body portion 35 which is adjustably mounted within the wall of the housing 31. The sleeve 34 at its end remote from the main body portion of the carrier 23 engages a washer which acts as an abutment for the adjacent end of the coiled compression spring 24. The axial position of the sleeve on the rod 33 determines the pre-load of the spring 24. The other end of the coiled compression spring bears against the base wall of the bore in the body portion 35 and the rod member 33 extends with clearance through the base wall and has secured thereon a retaining nut 36. The retaining nut 36 determines the extent of movement of the carrier member 23 under the action of the spring 24 whilst the abutment of the main portion of the carrier member 23 with the body portion 35 determines the amount by which the carrier member can move against the action of the spring 24.

The end of the rod 25 is secured against the base wall of a cup-shaped member 37 and sandwiched between the outer surface of the cup-shaped member and a retaining plate 38 is a diaphragm 39 the outer peripheral surface of which is trapped between the housing and a cover plate 40 which is secured to the housing. As is seen in FIG. 4, an inlet connection 41 is provided in the cover portion for connection to the inlet manifold of the associated engine. The diaphragm 39 constitutes the fluid pressure operable member which has been referred to earlier in the specification but in this case the cylinder 27 is replaced by a chamber which houses the cup-shaped member 37 and the diaphragm. The coil compression spring 29 abuts against the inner surface of the base wall of the cup-shaped member 37 and at its other end it bears against a stack of washers 42 interposed between the spring and the housing. The rod 25 is connected by means of a pin 43 to the lever 22 and the pin 43 extends laterally as seen in FIG. 4, and is engageable by a tongue 44 extending from an adjustable plate 45 secured by means of a bolt 46 within the housing.

As seen in FIG. 3, the housing 31 is provided with a side opening which is covered by a plate 47. The plate 47 is retained in position by means of a securing bolt 48 and this bolt is utilized to allow air to enter and leave the housing during movement of the diaphragm. For this purpose the bolt 48 is provided with a bore 49 which at one end communicates with the interior of the housing 31 and which at its other end is closed by a porous plug 50. The plug acts as a filter and in order to minimise so far as possible, the possibility of an operator removing the bolt 48, the head is provided with a cup-shaped cover 51 the side wall of which is deformed at several points beneath a ledge defined on the head of the bolt 48. The cover is free to rotate but at the same time allows the passage of air through the porous plug 50.

The operation of the practical construction is the same as described with reference to FIG. 1. In the practical construction however three points of adjustment are provided. Firstly the thickness of the stack of washers 42 can be adjusted as also can be the setting of the tongue member 44. The position of the tongue member 44 determines by means of pin 43, lever 22 and stop member 20, return the movement of the cup-shaped member and hence the maximum fuel available at light load. The thickness of the stack of washers effectively adjusts the pre-load of the spring 29 and thereby in conjunction with the position of the tongue member 44 determines the predetermined pressure in the air inlet manifold at which an increase of fuel can take place.

The setting of the body part 35 within the housing is also adjustable and this determines the maximum amount of fuel which can be supplied to the engine when the pressure in the air inlet manifold is as high as it can attain that is to say when the diaphragm 39 has compressed the spring 29 the maximum extent. The extent of movement of the pivot carrier can be adjusted by adjustment of the nut 36 on the rod 33 and by adjustment of the sleeve 34 relative to the rod.

Figure 5:
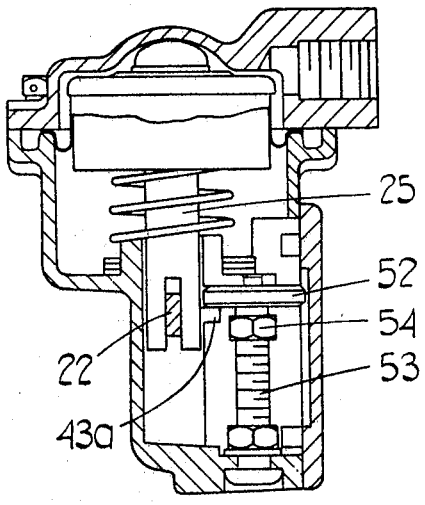
FIG. 5 is a view similar to FIG. 4 showing a modification.

In the arrangement shown in FIG. 5 the plate 45, the tongue 44 and nut 46 are omitted. Moreover, the pin 43 is replaced by a pin **43*a* which is shorter than the pin 43 and the tongue is replaced by a wheel 52 which is mounted on a threaded bolt 53 secured in the wall of the housing. A lock nut 54** is provided. The advantage of this arrangement is that adjustment is facilitated.

In the two examples the tongue and wheel limit the movement of the respective pin under the action of the spring 29. It is possible in each case to arrange instead that the extent of movement of the pin under the action of air pressure is limited. In the case of the arrangement of FIG. 2 this is achieved by mounting the plate 45 upside down so that the tongue 44 lies at the lower end of the plate. In the case of the arrangement of FIG. 5 the wheel 52 during assembly is positioned beneath the pin 43*a*.

I claim:

1. A fuel pumping apparatus for supplying fuel to a supercharged compression ignition engine the apparatus comprising an injection pump including a control member movable axially to vary the rate of fuel supply to the engine, governor means including an operator adjustable member, speed responsive means and a governor spring for determining the setting of the control member and the apparatus further comprising a housing, a stop member movably mounted in a wall of the housing said stop member being positioned to be engaged by said control member to determine the maximim rate of fuel supply by the apparatus, a pivot carrier mounted in the housing, said pivot carrier being movable in the direction of movement of said stop member, a lever pivotally mounted on said pivot carrier, one end of said lever defining a cam surface engageable with said stop member to determine the position thereof, a fluid pressure operable member connected to the other end of said lever, means whereby in use, said member can be subjected to the pressure of air in the air inlet manifold of the associated engine, first resilient means opposing movement of said fluid pressure operable member by said air pressure, and second resilient means biasing said pivot carrier, said second resilient means being deflected by force exerted by the governor spring to modify the maximum rate of fuel supply under certain operating conditions of the engine.

2. An apparatus according to claim 1 including means for limiting the extent of deflection of said second resilient means and further means for adjusting the position of the pivot carrier in the housing.

3. An apparatus according to claim 1, in which said pivot carrier comprises a main portion of forked construction, a pivot pin for said lever is carried by said main portion, a rod member is carried by said main portion, a cup shaped body portion is adjustably mounted in the housing having an aperture in a base wall thereof, said rod member extending into the body portion and through the aperture, and a member is adjustably mounted on said rod member, said second resilient means comprising a coiled compression spring acting between the base wall of the body portion and said member, said member co-operating with the internal surface of said body portion to guide relative movement of the rod member and the body portion.

4. An apparatus according to claim 3 including means secured to the end of the rod member remote from said main portion and cooperating with the base wall of the body portion to limit the extent of relative movement of the main portion and body portion under the action of said coiled compression spring.

5. An apparatus according to claim 4 in which said member is in screw thread engagement with the rod member.

6. An apparatus according to claim 1, in which there is provided a rod pivotally connected to said other end of the lever, said fluid pressure operable member being connected to said rod, and there is further provided an adjustable stop mounted within the housing, the pivot connection between said lever and said rod including a pivot pin which is laterally extended for engagement with said adjustable stop.

7. An apparatus according to claim 6 in which said fluid pressure operable member includes a cup-shaped member secured to said rod and a rolling diaphragm supported by said cup-shaped member, the external periphery of said diaphragm being secured within the housing to define one wall of a chamber to which air under pressure can be supplied from an inlet connected in use to the inlet manifold of the associated engine.

8. An apparatus according to claim 7, in which said first resilient means comprises a coiled compression spring located between said cup-shaped member and a wall of the housing, the apparatus including at least one shim located against one end of the spring and selectable to vary the force exerted by the spring.

9. An apparatus according to claim 6, in which there is provided a plate adjustably secured within the housing, said adjustable stop comprising a tongue member carried by said plate and being positioned by said plate to limit the movement of the lever under or against the action of said first resilient means.

10. An apparatus according to claim 6, in which there is provided a threaded bolt extending within the housing, said adjustable stop comprising a wheel having screw threaded engagement with said bolt and being positionable to limit the movement of the lever under or against the action of the first resilient means.

11. An apparatus according to claim 10 including a lock nut for locking said wheel against movement once adjustment has been effected.

* * * * *